US007138593B2

(12) United States Patent
Toyoda

(10) Patent No.: US 7,138,593 B2
(45) Date of Patent: Nov. 21, 2006

(54) KEYTOP COMPONENT, OPERATION KEY, AND ELECTRONIC DEVICE

(75) Inventor: Shigeru Toyoda, Kanagawa (JP)

(73) Assignee: Ricoh Company, Ltd., Toyko (JP)

( * ) Notice: Subject to any disclaimer, the term of this patent is extended or adjusted under 35 U.S.C. 154(b) by 0 days.

(21) Appl. No.: 11/228,252

(22) Filed: Sep. 19, 2005

(65) Prior Publication Data

US 2006/0060462 A1 Mar. 23, 2006

(30) Foreign Application Priority Data

Sep. 22, 2004 (JP) ..... 2004-275614
Jul. 5, 2005 (JP) ..... 2005-196821

(51) Int. Cl.
*H01H 13/02* (2006.01)

(52) U.S. Cl. ..... 200/345; 200/341

(58) Field of Classification Search ..... 200/5 A, 200/341–345; 341/22, 23, 28; 345/168, 345/169; 400/490–496
See application file for complete search history.

(56) References Cited

U.S. PATENT DOCUMENTS 4,294,555 A * 10/1981 Galaske et al. ..... 400/488
5,183,346 A * 2/1993 Tesar ..... 400/490
6,102,394 A * 8/2000 Wurz et al. ..... 273/138.2
6,284,992 B1 * 9/2001 Richter ..... 200/344
6,809,278 B1 * 10/2004 Tsubaki ..... 200/341
6,870,114 B1 * 3/2005 Cole et al. ..... 200/341
6,900,404 B1 * 5/2005 Searle et al. ..... 200/341

FOREIGN PATENT DOCUMENTS

JP 10-269001 10/1998
JP 3083182 10/2001

* cited by examiner

*Primary Examiner*—Michael A. Friedhofer
(74) *Attorney, Agent, or Firm*—Oblon, Spivak, McClelland, Maier & Neustadt, P.C.

(57) ABSTRACT

A keytop component for use in a keytop support member is disclosed that presses a key switch when the keytop component is pressed down. The keytop component includes a keytop member and a base member. The keytop member includes a pair of engagement members. The base member includes a pair of engagement receiving parts to be engaged by the pair of engagement members so as to detachably hold the keytop member, a locking section to lock the base member to the keytop support member, and a projection member extending downward under the base member for pressing the key switch when the base member is pressed down.

6 Claims, 6 Drawing Sheets

KEYTOP COMPONENT, OPERATION KEY, AND ELECTRONIC DEVICE

BACKGROUND OF THE INVENTION

1. Field of the Invention

The present invention relates to a keytop component that allows easy changing of printed indications along with a function change, an operation key having the keytop component, and an electronic device, such as a copy machine and a fax machine, having the operation key.

2. Description of the Related Art

Conventionally, operations panels of electronic devices, such as copy machines and fax machines, have been provided with various operation keys.

FIG. 12 schematically illustrates the configuration of a related-art operation key.

The operation key shown in FIG. 12 comprises a keytop component 51 and a key switch 61. The keytop component 51 serves as an operation button. An indication representing its function is printed on the upper surface of the keytop component 51. The key switch 61 is located under the keytop component 51 and configured to be turned on when the keytop component 51 is pressed.

To prevent the keytop component 51 from being separated from a cover 53 during use, the keytop component 51 includes locking claws 52 that are inserted into holes formed in the cover 53 so as to lock the keytop component 51 to the cover 53. Patent Documents 1 and 2 disclose related-art keytop components.

[Patent Document 1] Japanese Utility Model Registration No. 3083182

[Patent Document 2] Japanese Patent Laid-Open Publication No. 10-269001

When the function of the operation key is changed, the keytop component is replaced by another keytop component on which characters, symbols and the like representing a new function are printed.

For replacing the keytop component 51 by another keytop component, the keytop component 51 is removed by disassembling the operations panel or by applying force against the locking claws 52. This may result in losing components or damaging the keytop component 51 and the cover 53.

These problems may be avoided by, for example, reducing the insertion depth of the locking claws 52 of the keytop component 51 so as to facilitate the removal of the keytop component 51. However, reducing the insertion depth of the locking claws 52 makes the keytop component 51 more likely to come off during use.

For example, the operation key comprising the keytop component 51 is required to securely complete an input even when an end section of the keytop component 51 is pressed. In the case where the keytop component 51 has a rectangular top surface, if an end section of the top surface in its longitudinal direction is pressed, the locking claw 52 formed at the opposite end section, which serves as a support point upon turning on the key switch 61, might come off because of its reduced insertion depth, and thus failing to turn on the key switch 61.

An example of a keytop replacing method is disclosed in Patent Document 1. With the disclosed method, however, a keytop might not be securely fixed to a component (keytop sheet) to which the keytop is attached, or the keytop might come off because of a small insertion depth of a claw.

SUMMARY OF THE INVENTION

Therefore, it is a general object of the present invention to provide a keytop component, an operation key having the keytop component, and an electronic device having the operation key to solve at least one problem described above. A specific object of the present invention is to provide a keytop component that allows easy changing of printed indications, an operation key having the keytop component, and an electronic device having the operation key.

According to an aspect of the present invention, there is provided a keytop component for use in a keytop support member to press a key switch when the keytop component is pressed down, the keytop component comprising a keytop member including a pair of engagement members; and a base member including a pair of engagement receiving parts to be engaged by the pair of engagement members so as to detachably hold the keytop member, a locking section to lock the base member to the keytop support member, and a projection member extending downward under the base member for pressing the key switch when the base member is pressed down.

With this configuration, the keytop member on which an indication representing, for example, a function of the key switch is printed can be easily detached from the base member. Therefore, the printed indication of the keytop component can be changed by replacing only the keytop members, i.e., printed parts. In other words, upon replacing a keytop component by another keytop component on which an indication representing a new function is printed, the printed part of the keytop component can be easily replaced by another printed part without disassembling an operations unit or removing the keytop component from the operations unit by force.

DETAILED DESCRIPTION OF THE PREFERRED EMBODIMENT

The following description provides an exemplary embodiment of the present invention with reference to the accompanying drawings.

Figure 1:
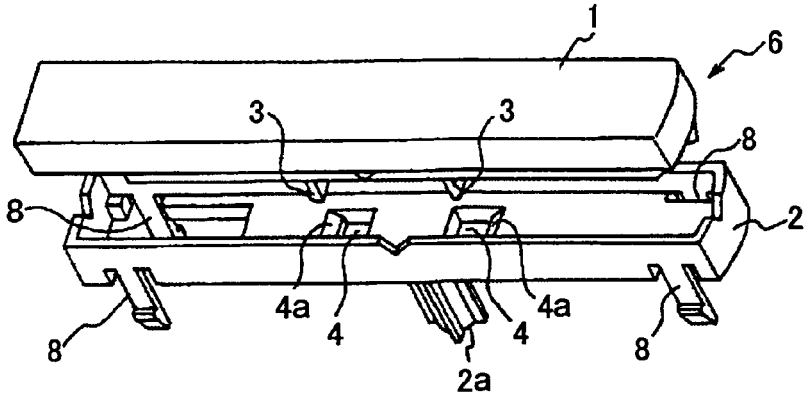
FIG. 1 is an exploded perspective view of a keytop component according to an embodiment of the present invention.
Figure 2:
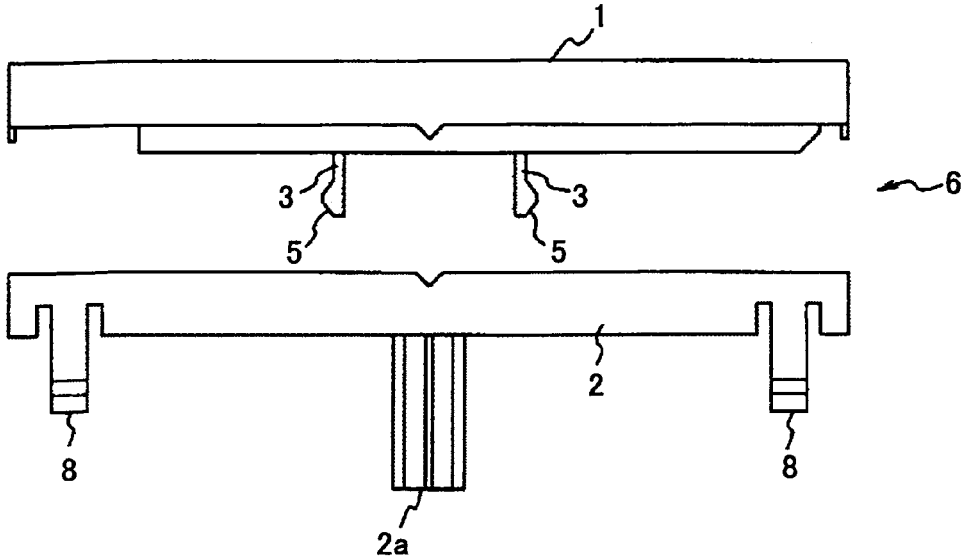
FIG. 2 is an exploded front view of the keytop component according to the embodiment.
Figure 3:
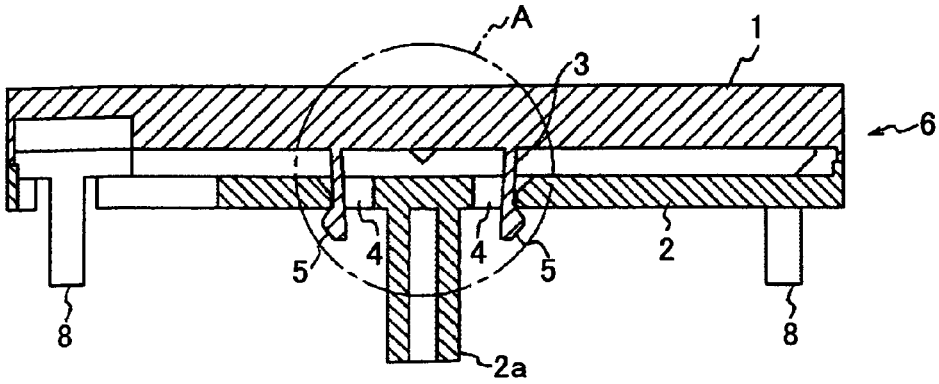
FIG. 3 is an assembly view of the keytop component according to the embodiment.
Figure 4:
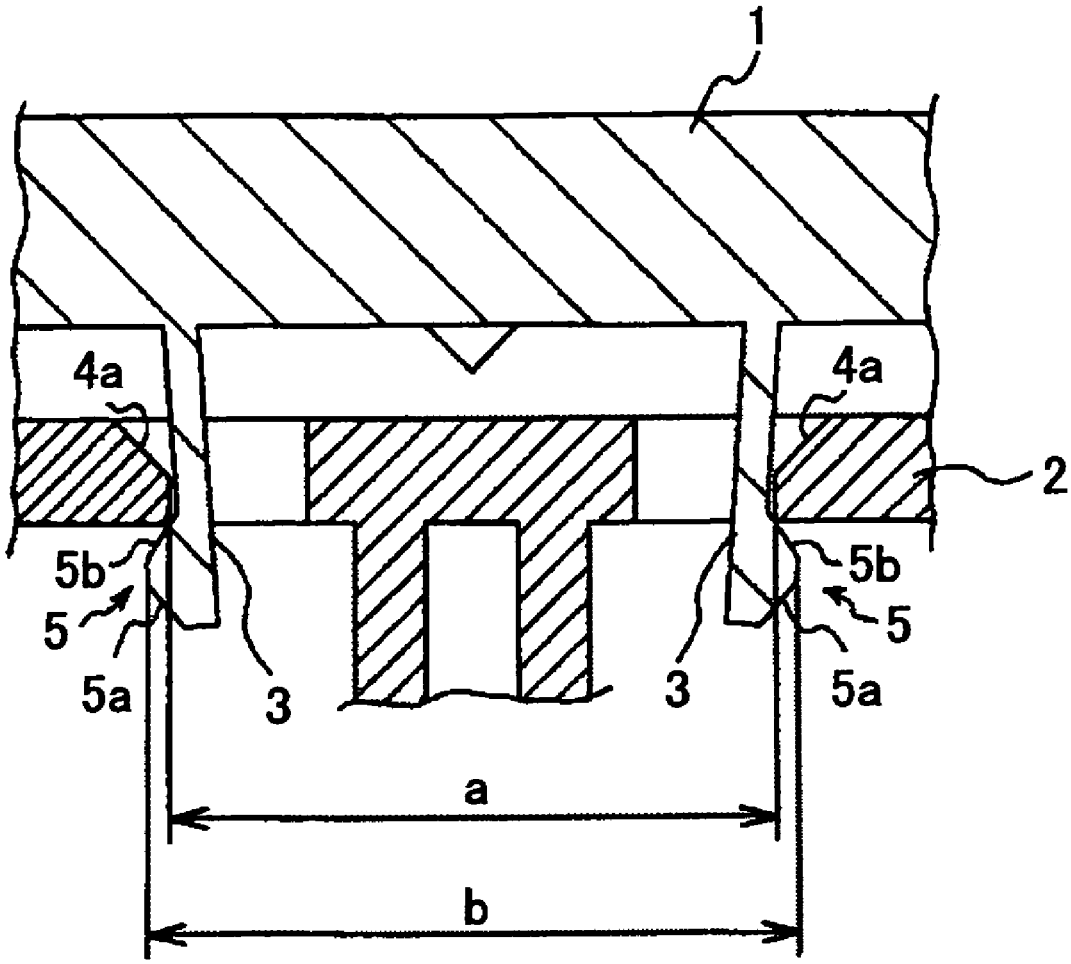
FIG. 4 is an enlarged view of an area of FIG. 3 enclosed by a broken line circle A.

FIG. 1 is an exploded perspective view of a keytop component 6 according to this embodiment. FIG. 2 is an exploded front view of the keytop component 6 according to the embodiment. FIG. 3 is an assembly view of the keytop component 6 according to the embodiment. FIG. 4 is an enlarged view of an area of FIG. 3 enclosed by a broken line circle A.

The keytop component 6 of this embodiment shown in FIGS. 1–4 comprises a keytop member 1 having an indication, such as characters and symbols, printed on an arbitrary section of the outer surface thereof for representing a function of a key switch, and a base member 2 detachably supporting the keytop member 1. If the function of the key switch is changed, the keytop member 1 on which the indication representing the function of the key switch is printed can be detached from the base member 2 and replaced without removing and replacing the base member 2.

A pair of downwardly-extending engagement members 3, 3 made of elastic material, such as resin, are formed on a bottom face of the keytop member 1. Receptacles 4, 4 are formed in the base member 2, serving as engagement receiving parts into which the engagement members 3, 3 are engaged (fitted). The engagement members 3, 3 and the receptacle 4, 4 are provided as a mechanism for attaching and detaching the keytop member 1 with respect to the base member 2 that detachably supports the keytop member 1. The engagement members 3, 3 are arranged to be symmetrical with respect to the center of the keytop member 1 in the longitudinal direction.

The base member 2 comprises locking claws (locking sections) 8 formed at each end of longitudinal side faces so as to secure (lock) the base member 2 to a keytop support member 9 (described later). A projection member 2a (described later) is formed at the center of a lower face of the base member 2.

Engagement protrusions 5, 5 are formed on the engagement members 3, 3 provided on the keytop member 1. As shown in detail in FIG. 4, the engagement protrusions 5, 5 have first slope faces 5*a*, 5*a* at the front side (lower side) of the engagement protrusions 5, 5 and second slope faces 5*b*, 5*b* at the rear side (upper side) of the engagement protrusions 5, 5. The first slope faces 5*a*, 5*a* serve as guide faces for guiding the engagement members 3, 3 into the receptacles 4, 4 when the keytop member 1 is pressed into the base member 2. The second slope faces 5*b*, 5*b* serve as engaging surfaces to engage peripheral edges of the receptacles 4, 4.

The receptacles 4, 4 have slope faces 4*a*, 4*a* at the upper side of inner walls so as to gradually narrow the receptacles 4, 4 toward the lower side. These slope faces 4*a*, 4*a* serve as guide faces such that the engagement members 3, 3 are smoothly pushed into the receptacles 4, 4.

With reference to FIG. 4, a distance "b" between outer points of the engagement members 3, 3 is greater than a distance "a" between the inner walls of the receptacles 4, 4, more specifically a distance between the most distant inner walls of the receptacles 4, 4.

While the keytop member 1 is engaged with the base member 2, the bottom face edge of the keytop member 1 abuts the upper face edge of the base member 2, thereby restricting the height such that the slope faces 5*b*, 5*b* of the engagement members 3, 3 are kept in contact with edges of the receptacles 4, 4. While the second slope faces 5*b*, 5*b* of the engagement protrusions 5, 5 are engaged on the edges of the receptacles 4, 4 as described above, the engagement members 3, 3 have outward forces to return to the original form with their elasticity. Accordingly, the engagement protrusions 5, 5 press against the edges of the receptacles 4, 4 of the base member 2 with the elasticity, thereby maintaining the engagement between the keytop member 1 and the base member 2.

Figure 5A:
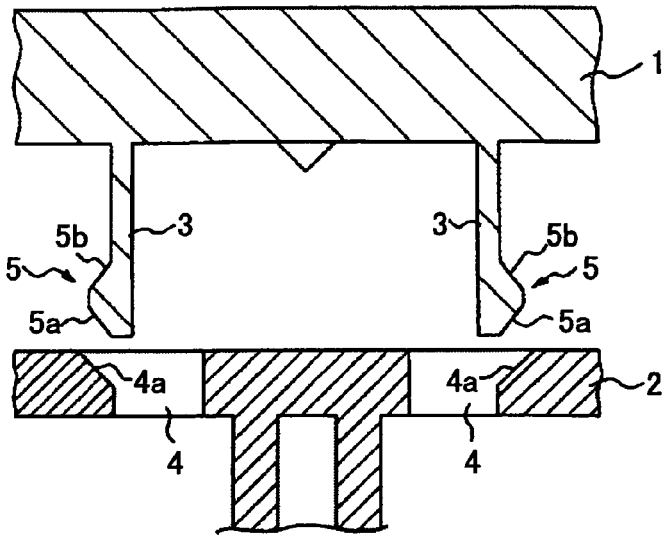
FIGS. 5A–5C illustrate an engagement operation of engagement members and engagement receiving parts.
Figure 5B:
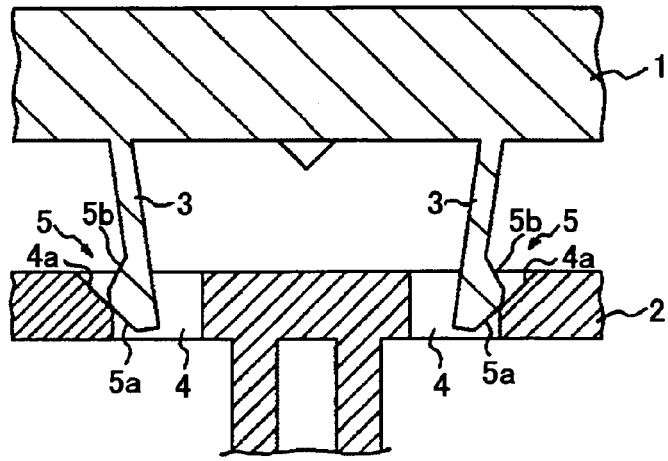
Figure 5C:
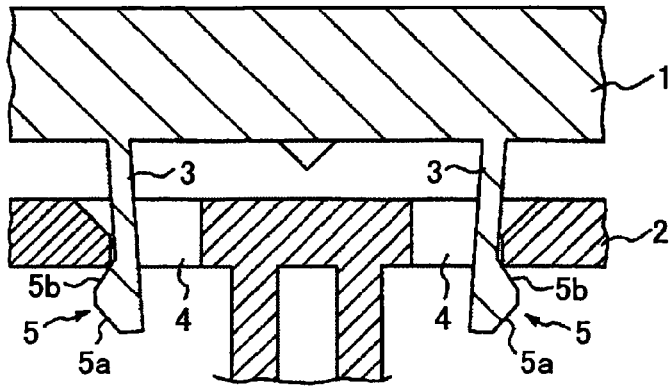

FIGS. 5A–5C illustrate an engagement operation of the engagement members 3, 3 and the receptacles 4, 4.

When the keytop member 1 separated from the base member 2 as shown in FIG. 5A is moved to the base member 2, the first slope faces 5*a*, 5*a* of the engagement protrusions 5, 5, of the engagement members 3, 3 are brought into contact with the slope faces 4*a*, 4*a* of the receptacles 4, 4 of the base member 2 as shown in FIG. 5B. Thus, the engagement members 3, 3 are inserted into the receptacles 4, 4 of the base member 2 while being deformed inwardly. Finally, as shown in FIG. 5C, the second slope faces 5*b*, 5*b* of the engagement protrusions 5, 5 of the engagement members 3, 3 abut the lower edges of the inner walls of the receptacles 4, 4. In this state, the engagement protrusions 5, 5 of the engagement members 3, 3 press against the edges of the receptacles 4, 4 as described above, thereby maintaining the engagement between the keytop member 1 and the base member 2.

For detaching the keytop member 1 engaged as shown in FIG. 5C, the keytop member 1 is pulled upward with a force greater than engagement forces (pressures) between the engagement protrusions 5, 5 of the engagement members 3, 3 and the edges of the receptacles 4, 4. In this way, the engagement members 3, 3 are elastically deformed inward to come out of the receptacles 4, 4.

As described above, because the keytop component 6 of this embodiment comprises the keytop member 1 including the pair of engagement members 3, 3 and the base member 2 including the pair of receptacles 4, 4, it is possible to detach only the keytop member 1 from the base member 2 with ease.

In this embodiment, the keytop member 1 includes the pair of engagement members 3, 3, and the base member 2 includes the pair of receptacles 4, 4. As an alternative configuration, for example, the keytop member 1 may include the pair of receptacles 4, 4, and the base member 2 may include the pair of engagement members 3, 3. The shape of the receptacle 4 is not limited to a rectangle, but may be other shapes including a circle. Although the receptacle 4 is exemplified as the engagement receiving part for receiving the engagement member 3 in this embodiment, the engagement receiving part is not limited to the receptacle 4 as shown in the drawings.

While the engagement protrusions 5, 5 of the pair of engagement members 3, 3 have top points facing outward, the engagement protrusions 5, 5 may alternatively have top points facing inward.

Figure 6:
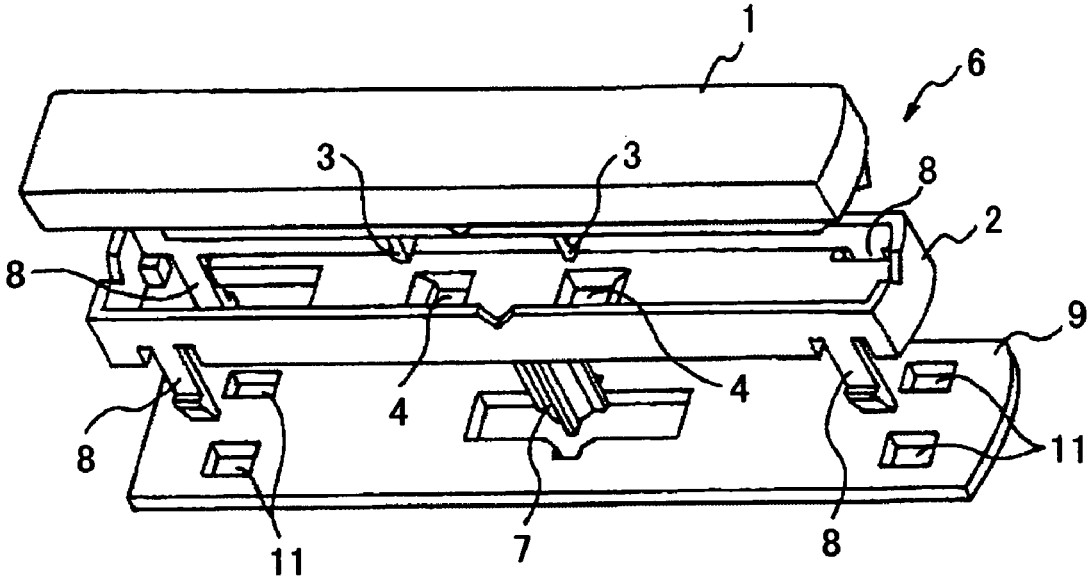
FIG. 6 is an exploded view of the keytop component ready to be attached to a keytop support member according to the embodiment.
Figure 7:
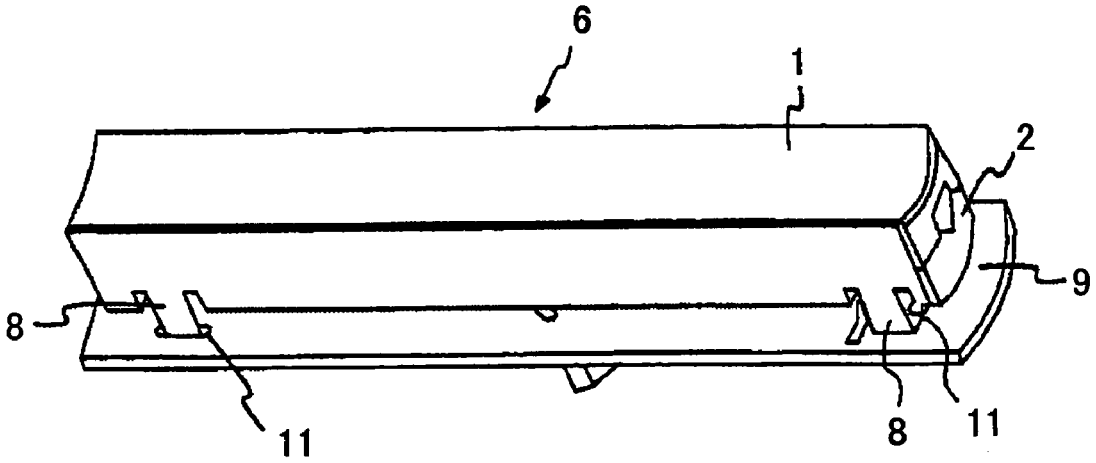
FIG. 7 is an assembly view of the keytop component attached to the keytop support member according to the embodiment.
Figure 8:
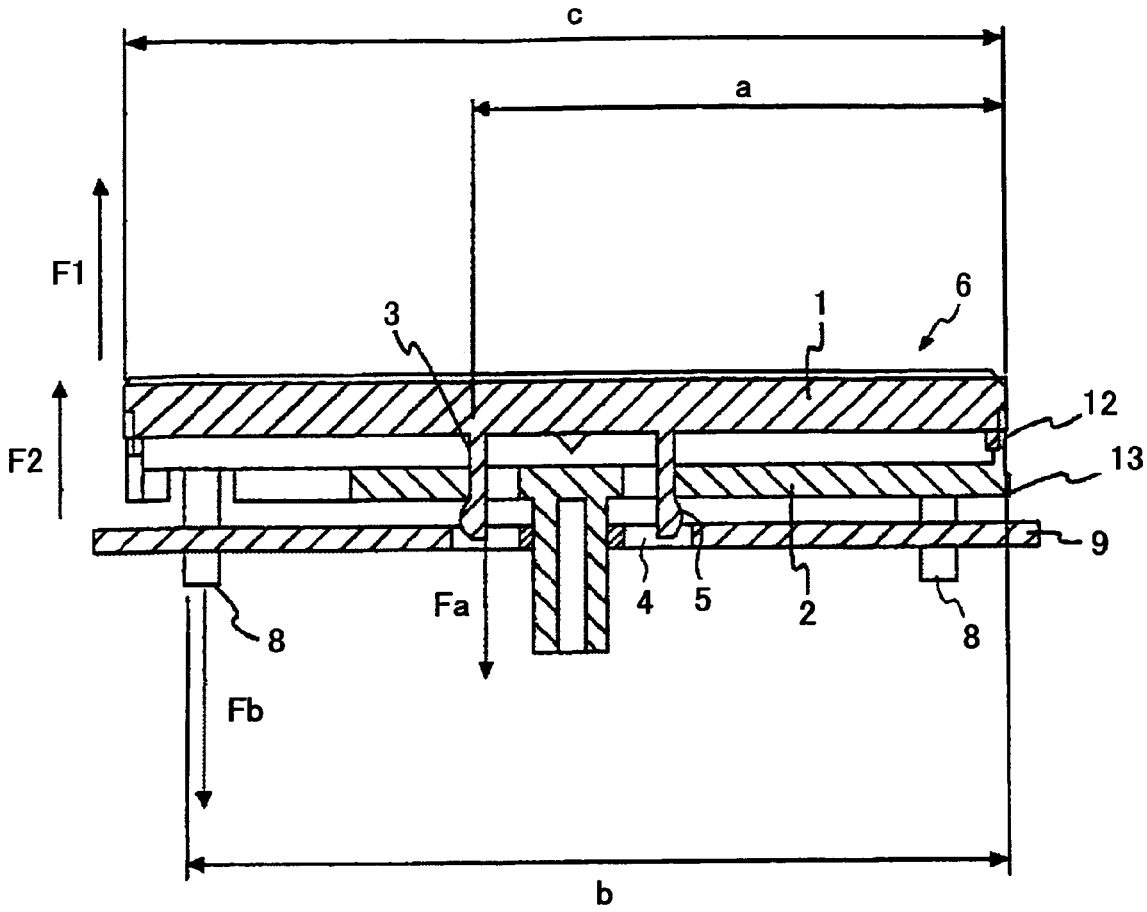
FIG. 8 is a front cross-sectional view of the keytop component attached to the keytop support member.

FIG. 6 is an exploded view of the keytop component 6 ready to be attached to the keytop support member 9 according to the embodiment. FIG. 7 is an assembly view of the keytop component 6 attached to the keytop support member 9 according to the embodiment. FIG. 8 is a front cross-sectional view of the keytop component 6 attached to the keytop support member 9.

Figure 9:
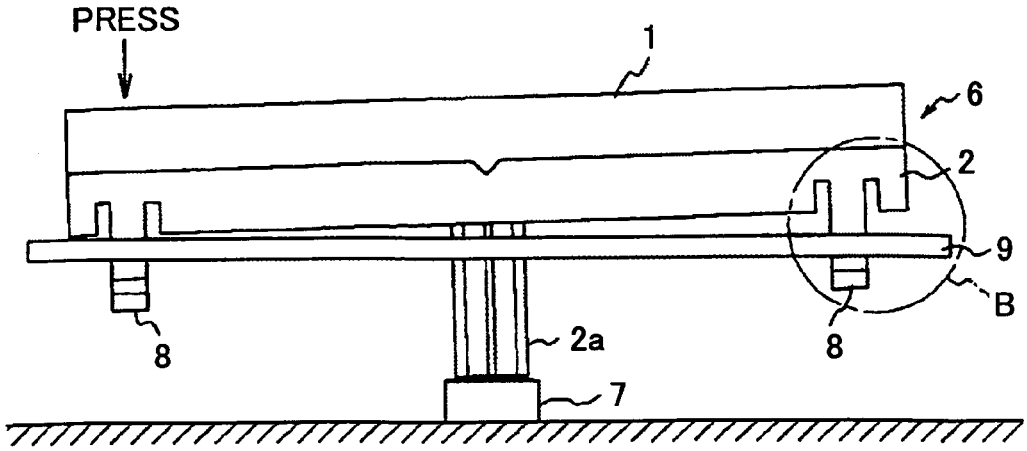
FIG. 9 illustrates the keytop component with its end section pressed according to the embodiment.
Figure 10:
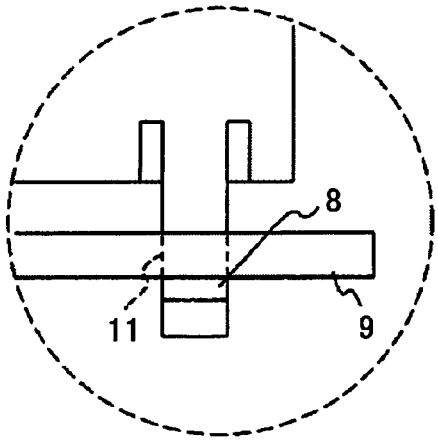
FIG. 10 is an enlarged view of an area of FIG. 9 enclosed by a broken line circle B.
Figure 11A:
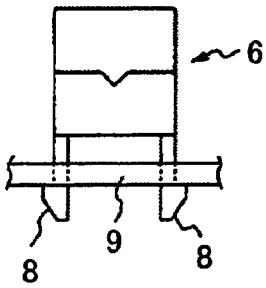
FIGS. 11A and 11B are side views illustrating the keytop component of FIG. 9.
Figure 11B:
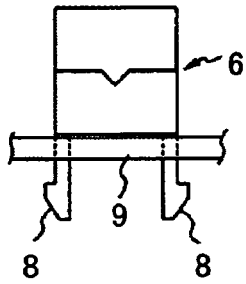
Figure 12:
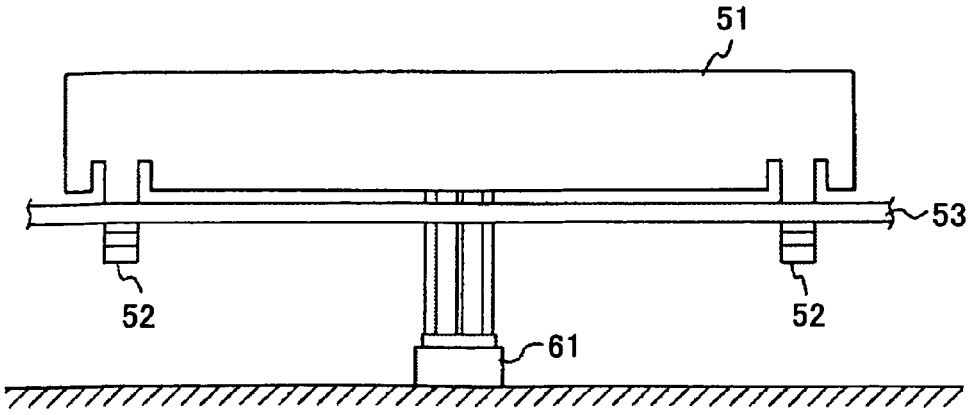
FIG. 12 is a schematic diagram illustrating the configuration of a related-art operation key.

FIG. 9 illustrates the keytop component 6 with its end section pressed according to the embodiment. FIG. 10 is an enlarged view of an area of FIG. 9 enclosed by a broken line circle B. FIGS. 11A and 11B are a right side view and a left side view, respectively, illustrating the keytop component 6.

With reference to FIGS. 6–8, when the keytop component 6 of this embodiment is attached to the keytop support member 9 of, for example, a cover of a device body, the locking claws 8 provided at the lower part of the base member 2 are inserted in locking holes 11 of the keytop support member 9 so as to prevent the base member 2 from being easily removed from the keytop support member 9. In this state, the base member 2 of the keytop component 6 is not fixed to the keytop support member 9 and is movable up and down. Therefore, when the keytop component 6 is pressed down, the keytop component 6 is moved downward to turn on a key switch 7 provided on a printed circuit board.

In the keytop component 6 of this embodiment, the insertion depth of the locking claws 8 with respect to the locking holes 11 of the keytop support member 9 is increased so as to make the locking claws 8 hardly separated from the keytop component 6. Therefore, when only the keytop member 1 of the keytop component 6 is pulled upward, only the keytop member 1 is detached from the base member 2 without pulling the locking claws 8 out of the locking holes 11 of the keytop support member 9.

In order to surely turn on the key switch 7 even when an end section of the keytop component 6 is pressed as shown in FIG. 9, the keytop component 6 of this embodiment is configured such that the locking claws 8 have enough insertion depth with respect to the keytop support member 9 as shown in FIGS. 10, 11A and 11B. Moreover, the keytop component 6 of this embodiment is allowed to move, when pressed down, twice or more than twice as much as the distance required for turning on the key switch 7. With this configuration, when a left end section of the keytop component 6 is pressed as shown in FIG. 9, the keytop component 6 is moved downward while the locking claws 8 provided at the right end section of the keytop component 6 serve as a support point. The projection member 2*a* disposed generally at the center between the pressed section of the keytop component 6 and the support point is moved downward half the distance that the pressed section is moved downward. Therefore, by allowing the pressed section to move downward twice or more than twice as much as the distance required for turning on the key switch, the key switch 7 is surely turned on.

Although the locking claws 8 of the base member 2 are configured not to be separated from the keytop support member 9 in the above description, the locking claws 8 of the base member 2 may be configured to be separable from the keytop support member 9.

In that case, for surely detaching the keytop member 1 from the base member 2 without separating the locking claws 8 from the keytop support member 9 when an end section (left end section shown in FIG. 8) of the keytop member 1 in the longitudinal direction is pulled upward in order to detaching only the keytop member 1, the engagement member 3 is arranged closer to the locking claws 8 of the base member 2, i.e., closer to a point 12 that serves as a support point when the keytop member 1 is separated from the base member 2.

With reference to FIG. 8, the point 12 serves as a support point when the keytop member 1 is separated from the base member 2, while a point denoted by the reference number 13 serves as a support point when the base member 2 is separated from the keytop support member 9.

A force F1 required for detaching the keytop member 1 from the base member 2 is represented by F1=a/c×Fa, in which Fa is a force required for releasing the engagement of the engagement members 3, and Fb is a force required for releasing the locking of the locking claws 8. A force F2 required for detaching the base member 2 from the keytop support member 9 of the cover is expressed by F2=b/c×Fb.

When Fa=Fb, F1 is smaller than F2 because "a" is smaller than "b". As described above, by arranging engagement member 3 of the keytop member 1 closer to the support point 12 than the locking claws 8 are, it becomes possible to detach the keytop member 1 from the base member 2 more easily than detaching the base member 2 from the keytop support member 9.

It should be understood that the keytop component 6 of this embodiment can be used as a keytop component provided in keyboards and operations unit of various types of electronic devices. Also, this keytop component is applicable to various types of electronic devices (image forming devices, image reading devices, communication devices, optical devices, personal computers, etc.).

The present application is based on Japanese Priority Application No. 2004-275614 filed on Sep. 22, 2004, and Japanese Priority Application No. 2005-196821 filed on Jul. 5, 2005, with the Japanese Patent Office, the entire contents of which are hereby incorporated by reference.

What is claimed is:

1. A keytop component for use in a keytop support member to press a key switch when the keytop component is pressed down, the keytop component comprising:

a base member mounted upon said keytop support member; and a keytop member mounted upon said base member, said keytop member including:

a first surface configured to be pushed by a user;

a second surface configured to abut a surface of said base member; and a pair of resilient engagement members that protrude beyond the second surface, said base member including: a pair of engagement receiving parts to be engaged by the pair of engagement members so as to detachably hold the keytop member; a locking section to lock the base member to the keytop support member; and a projection member extending downward under the base member and configured to press the key switch when the base member is pressed down, each of said engagement members including, at a tip end part thereof including a tip end of said engagement member, an engagement part for engagement with one of said engagement receiving parts corresponding thereto, said engagement part including a first sloped surface extending from said tip end toward a root part of said engagement member and a second sloped surface formed behind said first sloped surface when viewed from said tip end of said engagement member, such that said first and second sloped surfaces form together a trapezoidal shape for said engagement part such that said engagement member increases a thickness thereof in correspondence to said first sloped surface in a direction from said tip end toward said second sloped surface and decreases the thickness thereof in correspondence to said second sloped surface in a direction from said first sloped surface to said root part of said engagement member, said locking section including a hook engaging with a rear surface of said keytop support member at a side of said keytop support member away from a side facing said base member.

2. The keytop component as claimed in claim 1, wherein the pair of engagement receiving parts includes a pair of receptacles for engagement with said engagement parts formed on the engagement members, each of said receptacles including a sloped surface for engagement with said first sloped surface of said engagement part corresponding thereto when said pair of resilient engagement members are inserted to said engagement receiving parts.

3. The keytop component as claimed in claim 2, wherein said first and second sloped surfaces are formed at respective outer edges of said resilient engagement members, each of said outer edges being located at a side of said resilient engagement member away from an inner edge that faces another of said resilient engagement members.

4. The keytop component as claimed in claim 3, wherein said resilient engagement members are formed on said base member with a first mutual separation larger than a mutual separation of said engagement receiving parts on said base member.

5. An operation key comprising:

a key switch; and the keytop component of claim 1 for selectively pressing the key switch.

6. An electronic device comprising:

the operation key of claim 5.

* * * * *